US009520629B2

(12) United States Patent
Iso et al.

(10) Patent No.: US 9,520,629 B2
(45) Date of Patent: Dec. 13, 2016

(54) PHASE-SHIFT CIRCUIT AND ANTENNA DEVICE

(71) Applicant: Hitachi Metals, Ltd., Minato-ku, Tokyo (JP)

(72) Inventors: Naoki Iso, Hitachi (JP); Masahisa Kaneta, Hitachi (JP); Nobuaki Kitano, Hitachi (JP); Tomoyuki Ogawa, Hitachi (JP); Yoshiaki Ishigami, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 67 days.

(21) Appl. No.: 14/714,823

(22) Filed: May 18, 2015

(65) Prior Publication Data

US 2015/0357696 A1 Dec. 10, 2015

(30) Foreign Application Priority Data

Jun. 9, 2014 (JP) ..... 2014-119035

(51) Int. Cl.

| | |
|---|---|
| ***H01Q 13/00*** | (2006.01) |
| ***H01P 1/18*** | (2006.01) |
| ***H01Q 3/32*** | (2006.01) |
| ***H01Q 3/36*** | (2006.01) |

(52) U.S. Cl.
CPC ..... *H01P 1/184* (2013.01); *H01Q 3/32* (2013.01); *H01Q 3/36* (2013.01)

(58) Field of Classification Search
CPC ..... H01Q 3/36; H01Q 21/065; H01Q 3/30; H01P 1/181; H01P 1/184; H01P 1/18; H01P 1/183; H01P 1/182; H01P 1/20363; H01P 3/08; H01P 3/081; H01P 3/085; H01P 5/04
USPC .. 343/783, 853, 860, 905, 907, 343/700 MS, 343/911 R; 331/156, 159, 160, 161, 204, 232
See application file for complete search history.

(56) References Cited

U.S. PATENT DOCUMENTS

| | | | | |
|---|---|---|---|---|
| 4,691,208 | A * | 9/1987 | Stern | H01Q 3/443 343/785 |
| 5,940,030 | A | 8/1999 | Hampel et al. | |
| 7,274,331 | B2 * | 9/2007 | Heiniger | H01P 1/184 333/156 |
| 2002/0014932 | A1 * | 2/2002 | Osadchy | H01P 1/181 333/161 |
| 2010/0225558 | A1 * | 9/2010 | Jonsson | H01P 1/183 343/860 |
| 2014/0104130 | A1 * | 4/2014 | Alexander | H01P 1/19 343/853 |
| 2014/0139401 | A1 * | 5/2014 | Peng | H01Q 3/26 343/905 |

(Continued)

*Primary Examiner* — Linh Nguyen
(74) *Attorney, Agent, or Firm* — Crowell & Moring LLP

(57) ABSTRACT

A phase-shift circuit being smaller in size than a conventional phase-shift circuit and being capable of causing a phase difference equivalent to or larger than that in the conventional phase-shift circuit between an input signal and an output signal is achieved. A phase-shift circuit includes: a signal line; and a dielectric member overlapping the signal line and being capable of reciprocating in a direction intersecting the signal line, and changes a phase of a signal propagating through the signal line. The dielectric member is configured of a frame body and a dielectric plate provided inside the frame body and having an overlapping area with the signal line increased or decreased by the reciprocation, and the frame body has a permittivity lower than a permittivity of the dielectric plate.

12 Claims, 8 Drawing Sheets

(56) References Cited

U.S. PATENT DOCUMENTS

| | | | | |
|---|---|---|---|---|
| 2014/0152400 | A1* | 6/2014 | Rogers | H01G 5/16 333/156 |
| 2015/0311573 | A1* | 10/2015 | Alexander | H01P 1/195 333/158 |

* cited by examiner

PHASE-SHIFT CIRCUIT AND ANTENNA DEVICE

CROSS-REFERENCE TO RELATED APPLICATION

The present application claims priority from Japanese Patent Application No. 2014-119035 filed on Jun. 9, 2014, the content of which is hereby incorporated by reference into this application.

TECHNICAL FIELD OF THE INVENTION

The present invention relates to a phase-shift circuit and an antenna device. More particularly, the present invention relates to a phase-shift circuit and an antenna device preferably applied to a base-station antenna device which exchanges electric waves with a mobile communication terminal such as a mobile phone.

BACKGROUND OF THE INVENTION

An electric wave (beam) emitted from a base-station antenna device, which is one of antenna devices, is often tilted (with a tilt angle). For example, an electric wave emitted from a base-station antenna device of a mobile phone is generally tilted with a downward tilt angle. This is for avoiding an electric wave emitted from the base-station antenna device from reaching outside an area (cell) allocated to the base-station antenna device. Patent Document 1 (U.S. Pat. No. 5,940,030) describes an example of a phase-shift circuit for providing a tilt angle to an electric wave emitted from an antenna device including a base-station antenna device.

The phase-shift circuit described in Patent Document 1 includes: a signal line; ground conductors facing each other across this signal line; and a dielectric plate (impedance-matching member) inserted into a gap between the signal line and each ground conductor. The dielectric plate is inserted into the gap from a direction perpendicular to an extending direction of the signal line so as to intersect the signal line.

Patent Document 1 describes that a phase of a signal outputted from the signal line is changed by increase/decrease in an amount of the intersection between the dielectric plate and the signal line, that is, in the overlapping area between the dielectric plate and the signal line, which results in a change in a tilt angle of an electric wave emitted from the antenna device. Specifically, the electric plate has a substantially triangular shape whose width gradually increases from a front side to a rear side in an inserting direction. Therefore, when the dielectric plate is moved forward in the inserting direction (when the amount of insertion is increased), the overlapping area between the dielectric plate and the signal line is increased, so that the phase of the signal outputted from the signal line is delayed.

SUMMARY OF THE INVENTION

In the phase-shift circuit disclosed in Patent Document 1, an input signal and an output signal are provided with a phase difference depending on a difference (an overlapping area difference) between an overlapping area between the dielectric plate and the signal line obtained before the movement of the dielectric plate and an overlapping area between the dielectric plate and the signal line obtained after the movement of the dielectric plate. Meanwhile, a movable distance of the dielectric plate has a limit. Therefore, in order to ensure the overlapping area difference required under conditions of the limit of the maximum movable distance of the dielectric plate, that is, in order to provide a predetermined phase difference to the input signal and the output signal, the area of the dielectric plate has to be increased, and therefore, the size of the phase-shift circuit adversely increases, and besides, the size of the antenna device on which the phase-shift circuit increases.

An object of the present invention is to achieve a phase-shift circuit being smaller in size than a conventional phase-shift circuit and being capable of causing a phase difference equivalent to or larger than that in the conventional phase-shift circuit between an input signal and an output signal.

A phase-shift circuit of the present invention includes: a signal line; and a dielectric member overlapping the signal line and being capable of reciprocating in a direction intersecting the signal line, and changes a phase of a signal propagating through the signal line. The dielectric member is configured of a frame body and a dielectric plate provided inside the frame body and having an overlapping area with the signal line increased or decreased by the reciprocation, and the frame body has a permittivity lower than a permittivity of the dielectric plate.

An antenna device of the present invention includes: a plurality of phase-shift circuits for changing a phase of an input signal; and a plurality of antenna elements to which a signal outputted from the phase-shift circuits is inputted, respectively. At least one of the plurality of phase-shift circuits includes: a signal line; and a dielectric member overlapping the signal line and being capable of reciprocating in a direction intersecting the signal line. The dielectric member is configured of a frame body and a dielectric plate provided inside the frame body and having an overlapping area with the signal line increased or decreased by the reciprocation, and the frame body has a permittivity lower than a permittivity of the dielectric plate.

In an aspect of the present invention, the dielectric member can move to a first position at which an area of the frame body occupying an overlapping area with the signal line is larger than an area of the dielectric plate and a second position at which an area of the dielectric plate occupying an overlapping area with the signal line is larger than the area of the frame body.

In another aspect of the present invention, the dielectric member has a first dielectric plate and a second dielectric plate adjacent to each other in a moving direction. The frame body includes a first frame part surrounding the first dielectric plate and a second frame part surrounding the second dielectric plate. The first dielectric plate and the second dielectric plate are independent from each other, and the first frame part and the second frame part are integrally formed.

In still another aspect of the present invention, the frame body includes a bridging part integrally formed with the first frame part and the second frame part and lying across the first frame part and the second frame part.

In still another aspect of the present invention, the frame body includes a reinforcing part integrally formed with the first frame part and the second frame part and lying across the first frame part and the second frame part. The reinforcing part is provided on at least one side of the bridging part so as to be separated from the bridging part.

In still another aspect of the present invention, a gap between the signal line and the frame body facing each other is narrower than a gap between the signal line and the dielectric plate facing each other.

According to the present invention, a phase-shift circuit being smaller in size than a conventional phase-shift circuit and being capable of causing a phase difference equivalent to or larger than that in the conventional phase-shift circuit between an input signal and an output signal is achieved, and an antenna device including the phase-shift circuit is achieved.

BRIEF DESCRIPTIONS OF THE DRAWINGS

DESCRIPTIONS OF THE PREFERRED EMBODIMENTS

An example of embodiments of the present invention is described below. Here, a base-station antenna device to which the present invention is applied and a phase-shift circuit for use in the base-station antenna device are described. Note that the base-station antenna device may be abbreviated as an "antenna device" in the following description.

Figure 1:
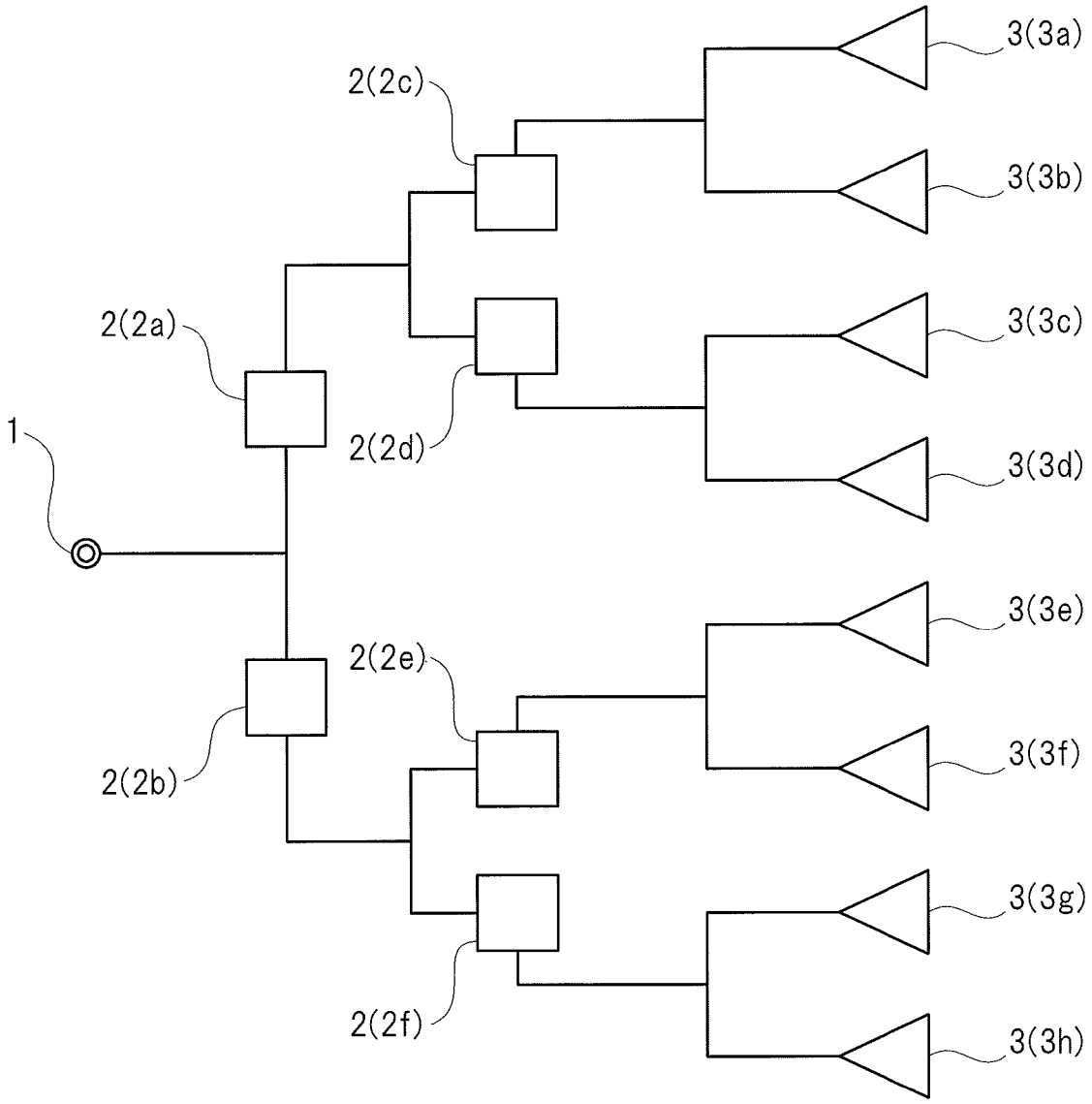
FIG. 1 is a structural diagram showing an example of an antenna device to which the present invention is applied.

As shown in FIG. 1, the antenna device according to the present embodiment has an input terminal 1, a plurality of phase-shift circuits 2, and a plurality of antenna elements 3. Specifically, the antenna device has six phase-shift circuits 2*a*, 2*b*, 2*c*, 2*d*, 2*e*, and 2*f*, and eight antenna elements 3*a*, 3*b*, 3*c*, 3*d*, 3*e*, 3*f*, 3*g*, and 3*h*. In the following description, the phase-shift circuits 2*a* to 2*f* may be collectively referred to as a "phase-shift circuit 2" and the antenna elements 3*a* to 3*h* may be collectively referred to as an "antenna element 3".

To the shown input terminal 1, a high-frequency signal outputted from a high-frequency circuit not shown is inputted. To the input terminal 1, the plurality of phase-shift circuits 2 and antenna elements 3 are connected in a tournament format. Therefore, the signal inputted to the input terminal 1 is split and inputted to a predetermined phase-shift circuit 2, and is then inputted to a predetermined antenna element 3.

Specifically, to the input terminal 1, input ends of the phase-shift circuits 2*a* and 2*b* are connected in parallel. To an output end of the phase-shift circuit 2*a*, input ends of the phase-shift circuits 2*c* and 2*d* are connected in parallel. To an output terminal of the phase-shift circuit 2*b*, input ends of the phase-shift circuits 2*e* and 2*f* are connected in parallel. The signal inputted to the input terminal 1 is split into two signals, and the two signals are inputted to the phase-shift circuits 2*a* and 2*b*, respectively. A signal outputted from the phase-shift circuit 2*a* is further split into two signals, and the two signals are inputted to the phase-shift circuits 2*c* and 2*d*, respectively. Also, a signal outputted from the phase-shift circuit 2*b* is further split into two signals, and the two signals are inputted to the phase-shift circuits 2*e* and 2*f*, respectively.

To an output end of the phase-shift circuit 2*c*, the antenna elements 3*a* and 3*b* are connected in parallel. To an output end of the phase-shift circuit 2*d*, the antenna elements 3*c* and 3*d* are connected in parallel. Similarly, to an output end of the phase-shift circuit 2*e*, the antenna elements 3*e* and 3*f* are connected in parallel. To an output end of the phase-shift circuit 2*f*, the antenna elements 3*g* and 3*h* are connected in parallel. Therefore, a signal outputted from the phase-shift circuit 2*c* is split into two signals, and the two signals are inputted to the antenna elements 3*a* and 3*b*, respectively. A signal outputted from the phase-shift circuit 2*d* is split into two signals, and the two signals are inputted to the antenna elements 3*c* and 3*d*, respectively. A signal outputted from the phase-shift circuit 2*e* is split into two signals, and the two signals are inputted to the antenna elements 3*e* and 3*f*, respectively. A signal outputted from the phase-shift circuit 2*f* is split into two signals, and the two signals are inputted to the antenna elements 3*g* and 3*h*, respectively. In the above-described course, each phase-shift circuit 2 changes the phase of the inputted signal and then outputs the resultant signal to each antenna element 3. That is, each phase-shift circuit 2 provides a predetermined phase difference between the input signal and the output signal. Thus, an antenna device with a predetermined directivity is achieved.

The phase-shift circuit 2 and the antenna element 3 are accommodated in, for example, a cylindrically-shaped housing. Specifically, the phase-shift circuits 2 and the antenna elements 3 are accommodated in the housing so that eight antenna elements 3 are aligned in a line along a longitudinal direction of the housing. For example, the antennal elements 3*a*, 3*b*, 3*c*, 3*d*, 3*e*, 3*f*, 3*g*, and 3*h* are aligned in a line in this order from an upper part of the housing toward a lower part thereof. Then, the phases of signals to be inputted to the respective antenna elements 3 are gradually delayed in accordance with the above-described arranging order of the antenna elements 3. That is, the phase of the signal to be inputted to the antenna element 3*a* arranged on the top is advanced most, and the phase of the signal to be inputted to the antenna element 3*h* arranged on the bottom is delayed most. With this, the electric wave emitted from the antenna device is tilted downward. Note that the antenna device is placed generally at a high location, and exchanges electric waves with a plurality of mobile phones or others scattered in lower locations. Thus, electric waves emitted from the antenna device are generally tilted downward from a horizontal plane.

Figure 2:
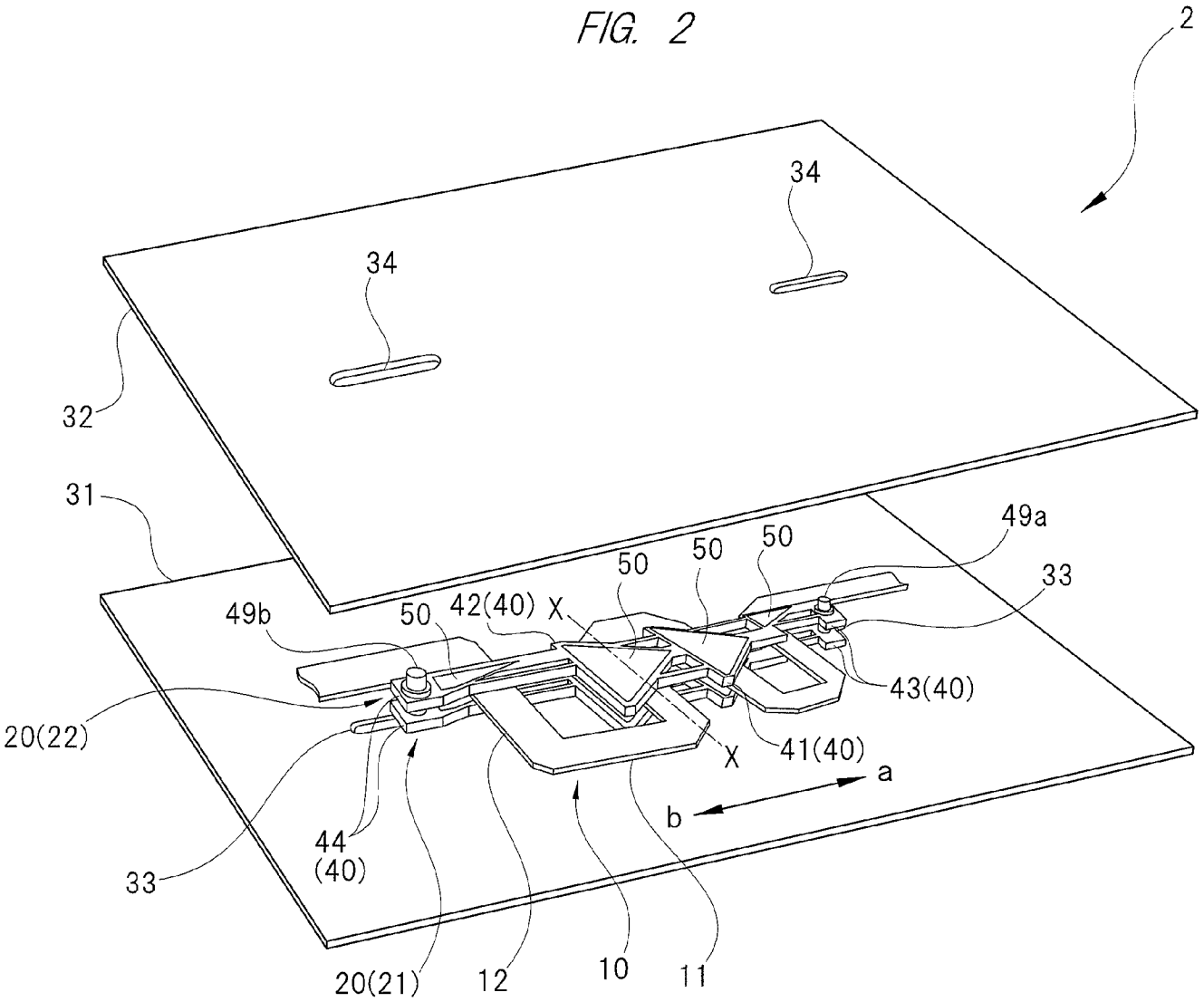
FIG. 2 is a perspective view showing an example of a phase-shift circuit to which the present invention is applied.

Next, the structure of the phase-shift circuit 2 shown in FIG. 1 is described. As shown in FIG. 2, the phase-shift circuit 2 has: a signal line 10; paired dielectric members 21 and 22 facing each other across the signal line 10; and paired ground conductors 31 and 32 facing each other across the signal line 10 and the dielectric members 21 and 22. The paired dielectric members 21 and 22 partially overlap the signal line 10. As shown in the drawing, the signal line 10 has a meander pattern (a zigzag pattern) in which a longitudinally extending part 11 and a laterally extending part 12 orthogonal to each other are alternately repeated. The paired dielectric members 21 and 22 overlap the laterally extending part 12 of the signal line 10, and reciprocate in parallel to the longitudinal extending part 11 of the signal line 10. That is, the paired dielectric members 21 and 22 can reciprocate in a direction indicated by an arrow "a-b" in FIG. 2.

Figure 3:
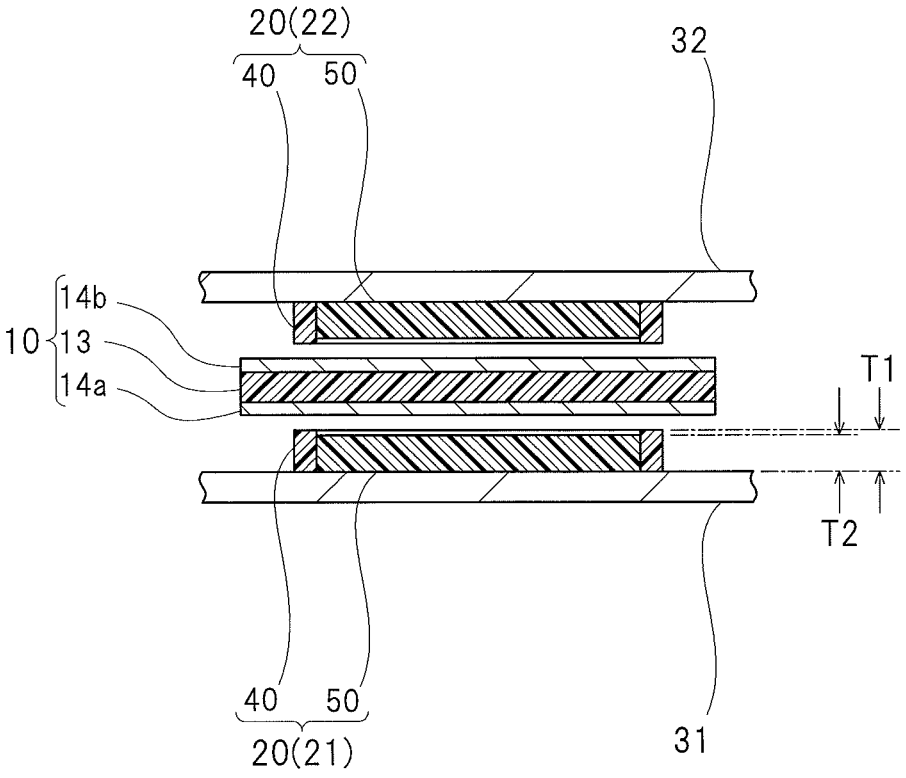
FIG. 3 is an enlarged cross-sectional view taken along a line X-X shown in FIG. 2.

As shown in FIG. 3, the signal line 10 is configured of a printed board 13 and signal conductors 14*a* and 14*b* formed on both surfaces of the printed board 13. The dielectric member 21 is arranged between the lower signal conductor 14*a* and the ground conductor 31, and the dielectric member 22 is arranged between the upper signal conductor 14*b* and the ground conductor 32. Thus, in the following description, the dielectric member 21 may be referred to as a "lower dielectric member 21" and the dielectric member 22 may be referred to as an "upper dielectric member 22" for distinction. However, this distinction is merely distinction for convenience of description, and the lower dielectric member 21 and the upper dielectric member 22 have the same shape, structure, and dimension as each other. Thus, in the following description, the lower dielectric member 21 and the upper dielectric member 22 may be collectively referred to as a "dielectric member 20".

Figure 4:
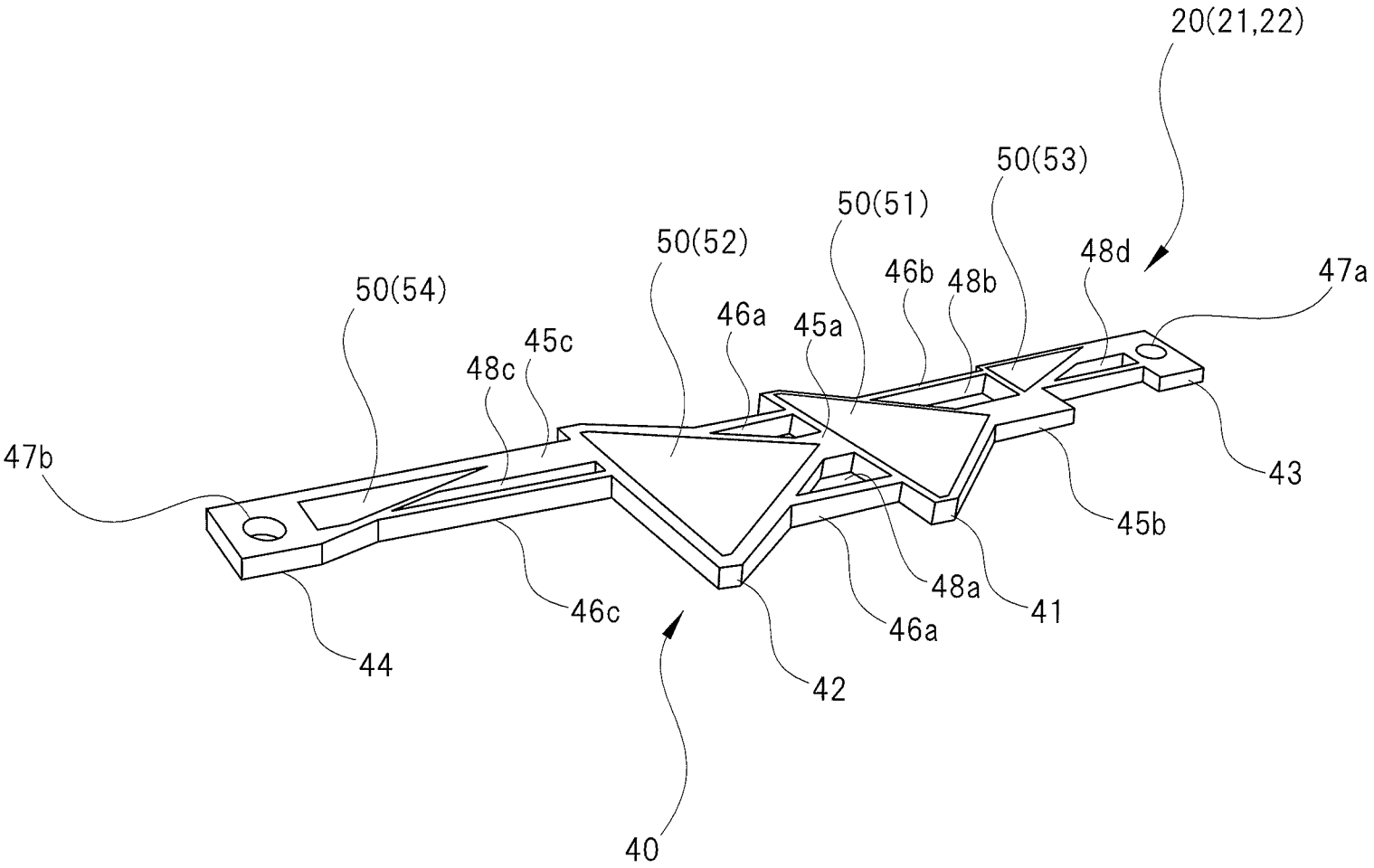
FIG. 4 is an enlarged perspective view of a dielectric member shown in FIG. 2.
Figure 5:
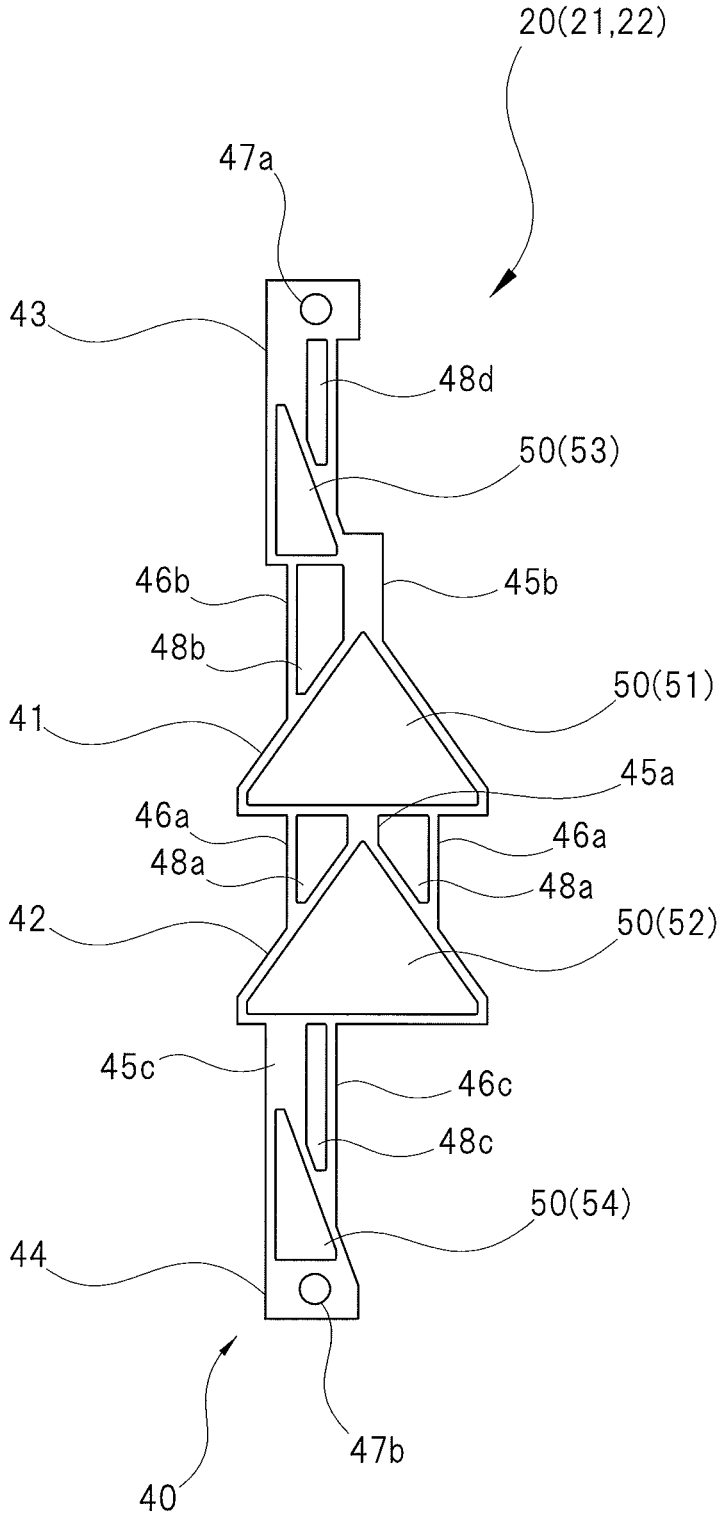
FIG. 5 is an enlarged plan view of the dielectric member shown in FIG. 2.

As shown in FIG. 4 and FIG. 5, the dielectric member 20 is configured of a frame body 40 and a plurality of dielectric plates 50 provided inside the frame body 40. The frame body 40 and the dielectric plates 50 are common with each other in that they are made of a resin material. However, a permittivity ($\epsilon$1) of the frame body 40 is lower than a permittivity ($\epsilon$2) of the dielectric plate 50. That is, the dielectric member 20 has a low permittivity portion (the frame body 40) and a high permittivity portion (the dielectric plate 50), and the high permittivity portion is surrounded by the low permittivity portion.

When the measurement frequency is 1 [GHz], the permittivity ($\epsilon$1) of the frame body 40 is preferably in a range of 2 to 4 [F/m], and the permittivity ($\epsilon$2) of the dielectric plate 50 is preferably in a range of 7 to 15 [F/m]. Furthermore, the permittivity ($\epsilon$1) of the frame body 40 is more preferably equal to or lower than 4 [F/m], and the permittivity ($\epsilon$2) of the dielectric plate 50 is more preferably equal to or higher than 12 [F/m]. While the frame body 40 in the present embodiment is made of polyacetal resin, the electric plate 50 is made of polyphenylene sulfide resin, so that each permittivity ($\epsilon$1 and $\epsilon$2) is within the above-described range.

As shown in FIG. 3, the frame body 40 has a thickness (T1) larger than a thickness (T2) of each dielectric plate 50. Thus, a gap between the signal line 10 (the signal conductors 14*a* and 14*b*) and the frame body 40 facing each other is narrower than a gap between the signal line 10 (the signal conductors 14*a* and 14*b*) and each dielectric plate 50 facing each other. In other words, a space between the signal line 10 and each dielectric plate 50 is defined by the thickness (T1) of the frame body 40, and the dielectric plate 50 is not too close to the signal line 10.

With reference to FIG. 4 and FIG. 5 again, the frame body 40 configuring the dielectric member 20 includes a first frame part 41, a second frame part 42, a third frame part 43, and a fourth frame part 44. The plurality of frame parts are aligned in a moving direction of the dielectric member 20 (the arrow a-b direction shown in FIG. 2) in the order of the third frame part 43, the first frame part 41, the second frame part 42, and then the fourth frame part 44. In other words, the third frame part 43 and the fourth frame part 44 are positioned at both ends of the frame body 40, and the first frame part 41 and the second frame part 42 are positioned between these third frame part 43 and fourth frame part 44. Thus, in the following description, the third frame part 43 may be referred to as a "front-end frame part 43" and the fourth frame part 44 may be referred to as a "rear-end frame part 44".

Between two frame parts that are adjacent to each other along the moving direction of the dielectric member 20, a bridging part lying across these frame parts is formed as appropriate. As shown in FIG. 5, a bridging part 45*a* is formed between the first frame part 41 and the second frame part 42. Also, a bridging part 45*b* is formed between the front-end frame part 43 and the first frame part 41, and a bridging part 45*c* is formed between the second frame part 42 and the rear-end frame part 44. Furthermore, a reinforcing part extending in the same direction as that of the bridging part is formed appropriately on one side or both sides of each bridging part. Specifically, paired reinforcing parts 46*a*, 46*a* lying across the first frame part 41 and the second frame part 42 are formed on both sides of the bridging part 45*a*. Also, on one side (a left side in the drawing) of the bridging part 45*b*, a reinforcing part 46*b* is formed across the front-end frame part 43 and the first frame part 41. Furthermore, on one side (a right side in the drawing) of the bridging part 45*c*, a reinforcing part 46*c* is formed across the second frame part 42 and the rear-end frame part 44. These frame parts, bridging parts, and reinforcing parts are integrally made of polyacetal resin.

Inside the first frame part 41, a first dielectric plate 51 is provided. Inside the second frame part 42, a second dielectric plate 52 is provided. Inside the front-end frame part 43, a third dielectric plate 53 is provided. Inside the rear-end frame part 44, a fourth dielectric plate 54 is provided. The first dielectric plate 51, the second dielectric plate 52, the third dielectric plate 53, and the fourth dielectric plate 54 are made of polyphenylene sulfide resin and are independent from each other.

The first dielectric plate 51 is formed substantially in an isosceles triangle shape when seen in a plan view, and has its entire perimeter surrounded by the first frame part 41. In other words, the first dielectric plate 51 fits in the inside of the first frame part 41. The second dielectric plate 52 has the same dimension and shape as those of the first dielectric plate 51, and has its entire perimeter surrounded by the second frame part 42. In other words, the second dielectric plate 52 fits in the inside of the second frame part 42. The third dielectric plate 53 and the fourth dielectric plate 54 are each formed substantially in a right triangle shape when seen in a plan view, and have their entire perimeters surrounded by the front-end frame part 43 and the rear-end frame part 44, respectively. In the front-end frame part 43, an insertion hole 47*a* penetrating through the frame body 40 is formed. In the rear-end frame part 44, an insertion hole 47*b* penetrating through the frame body 40 is formed.

Furthermore, a plurality of through parts (hollow parts) are formed in the frame body 40. Specifically, through parts 48*a* are formed between the bridging part 45*a* and the reinforcing parts 46*a*, 46*a* on both sides of the bridging part 45*a*, respectively. Also, a through part 48*b* is formed between the bridging part 45*b* and the reinforcing part 46*b*. Furthermore, a through part 48*c* is formed in the rear-end frame part 44, and a through part 48*d* is formed in the front-end frame part 43. That is, each reinforcing part is separated from its adjacent bridging part.

With reference to FIG. 2 again, two dielectric members 21 and 22 facing each other across the signal line 10 are coupled and integrated together by two pins 49*a* and 49*b*. Specifically, the pin 49*a* is inserted into the insertion hole 47*a* (FIG. 4 and FIG. 5) formed in the front-end frame part 43 of each of the dielectric members 21 and 22. Also, the pin 49*b* is inserted into the insertion hole 47*b* (FIG. 4 and FIG. 5) formed in the rear-end frame part 44 of each of the dielectric members 21 and 22. Furthermore, each of one ends of the pins 49*a* and 49*b* protruding from the dielectric members 21 and 22 is inserted into each of two long holes 33 formed in the ground conductor 31, and protrudes below the ground conductor 31. On the other hand, each of the other ends of the pins 49*a* and 49*b* protruding from the dielectric members 21 and 22 is inserted into each of two long holes 34 formed in the ground conductor 32, and protrudes above the ground conductor 32.

To at least one of the pins 49*a* and 49*b*, a moving mechanism not shown is connected. By this moving mechanism, the dielectric members 21 and 22 are reciprocated together in the arrow a-b direction. When the dielectric member 20 moves, each of the long holes 33 and 34 formed in the respective ground conductors 31 and 32 is functioned as a guide hole for guiding the movement of the dielectric member 20.

Figure 6:
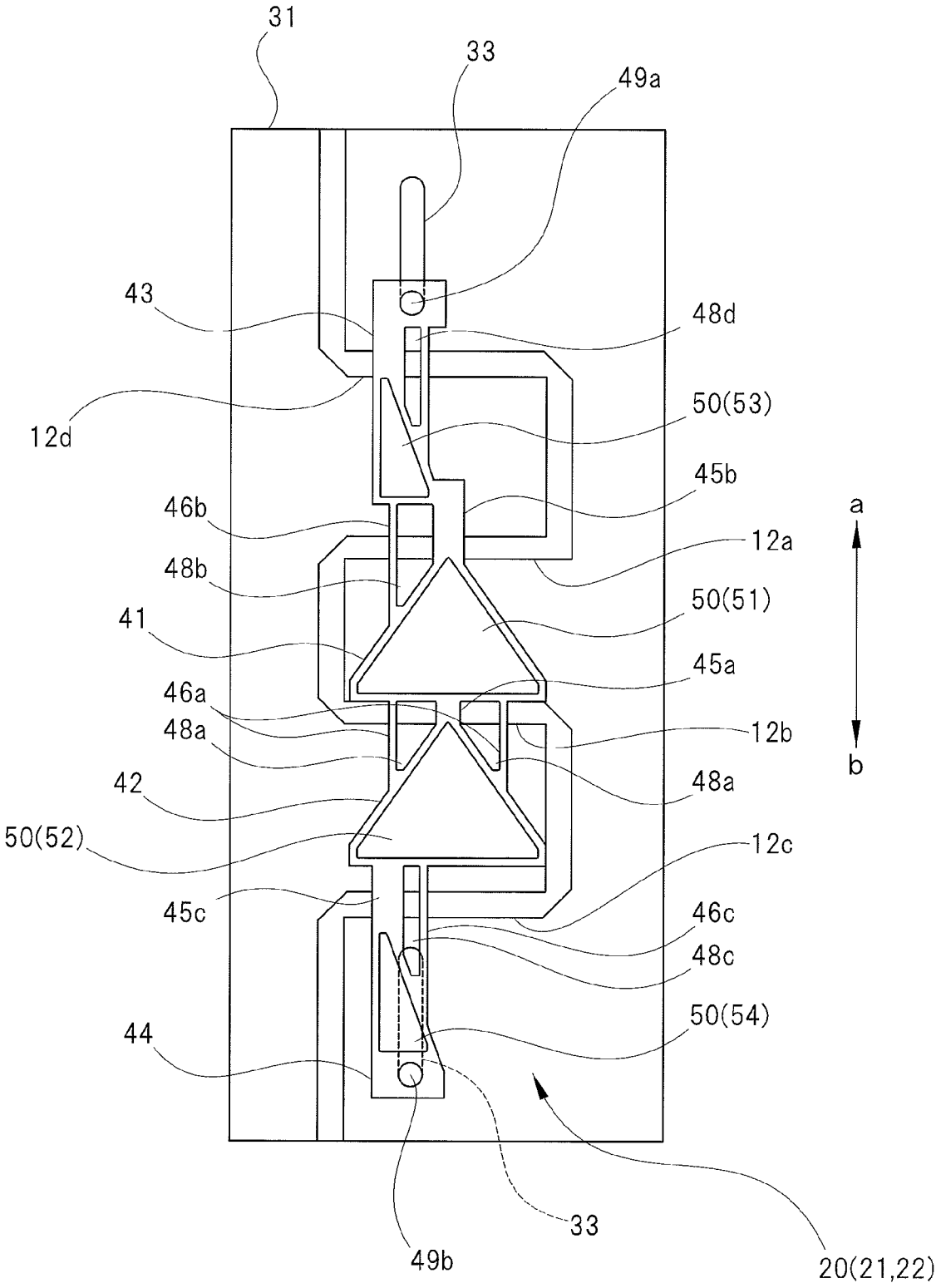
FIG. 6 is an enlarged plan view showing an overlapping state between a signal line and the dielectric member at a first position.
Figure 7:
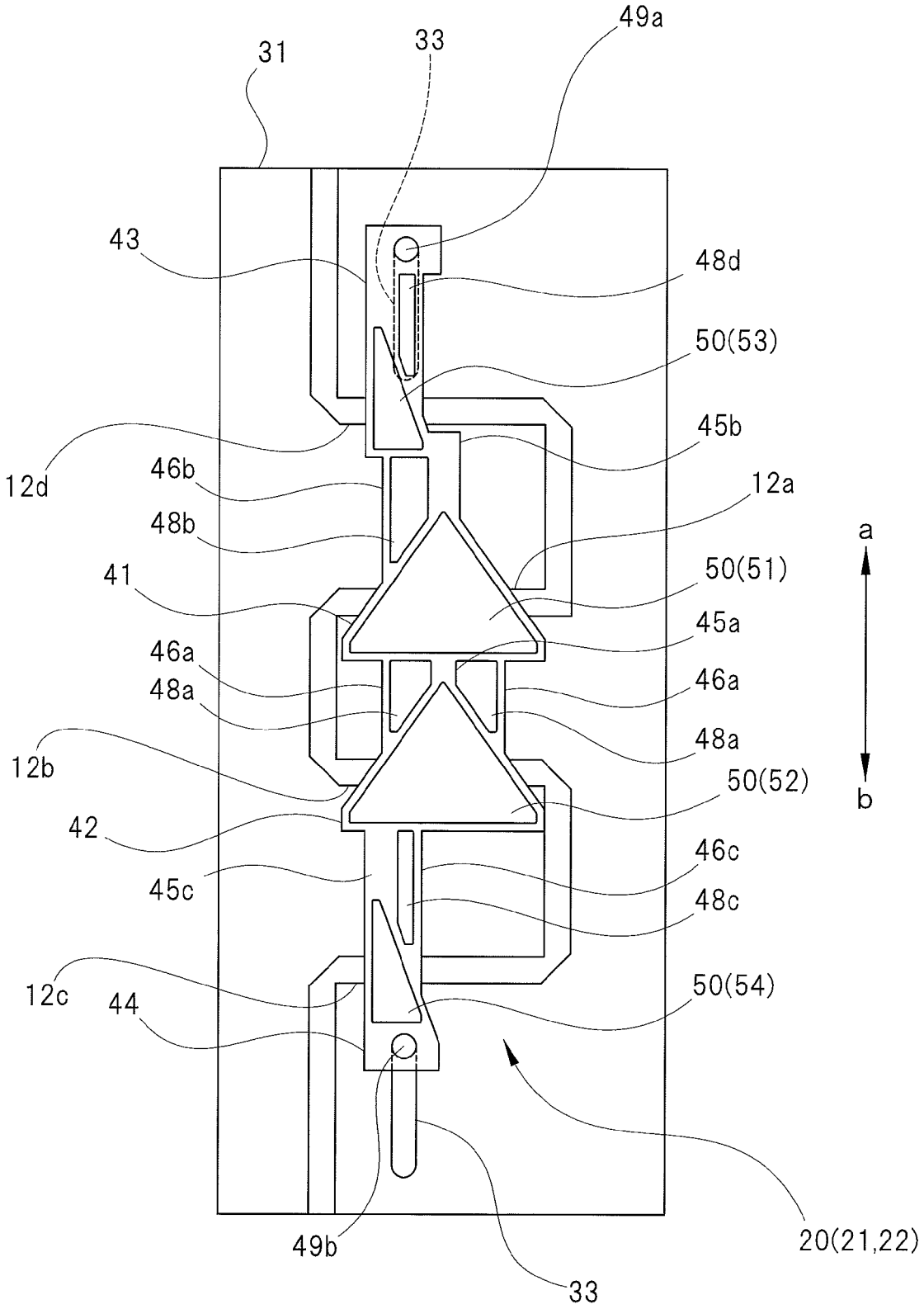
FIG. 7 is an enlarged plan view showing an overlapping state between the signal line and the dielectric member at a second position.

As shown in FIG. 6, the dielectric member 20 can move in the arrow b direction until the pins 49*a* and 49*b* each abut on one end (a rear end) of the long hole 33. Also, as shown in FIG. 7, the dielectric member 20 can move in the arrow a direction until the pins 49*a* and 49*b* each abut on the other end (a front end) of the long hole 33. Note that the ground conductor 32 shown in FIG. 2 is omitted in FIG. 6 and FIG. 7. When the pins 49*a* and 49*b* each abut on the rear end of the long hole 33, the pins 49*a* and 49*b* each also simultaneously abut on the rear end of the long hole 34 shown in FIG. 2. Furthermore, when the pins 49*a* and 49*b* each abut on the front end of the long hole 33, the pins 49*a* and 49*b* each also simultaneously abut on the front end of the long hole 34 shown in FIG. 2.

Each of the long holes 33 and 34 shown in FIG. 2 has an entire length of 12 mm. That is, the maximum moving distance of the dielectric member 20 is 12 mm. In the following description, the position (the position shown in FIG. 6) of the dielectric member 20 when the pins 49*a* and 49*b* each abut on the rear ends of the long holes 33 and 34 may be referred to as a "reference position". That is, the dielectric member 20 in the present embodiment can move by 12 mm at maximum from the reference position to the arrow a direction. However, the maximum moving distance of the dielectric member 20 can be arbitrarily changed by increasing or decreasing each entire length of the long holes 33 and 34. On the other hand, it is not required to set the maximum moving distance of the dielectric member 20 so as to match each entire length of the long holes 33 and 34. For example, a stopper which defines the maximum moving distance of the dielectric member 20 may be provided inside each of the long holes 33 and 34 or on each of the ground conductors 31 and 32.

As shown in FIG. 5, the dielectric plates 50 are arranged inside the frame body 40. In other words, the dielectric plates 50 are surrounded by the frame body 40. As shown in FIG. 6, when the dielectric member 20 is located at the reference position, only the frame body 40 surrounding the dielectric plates 50 overlaps the signal line 10. Specifically, the bridging part 45*a* and the reinforcing parts 46*a*, 46*a* partially overlap a laterally extending part 12*b* of the signal line 10, the bridging part 45*b* and the reinforcing part 46*b* partially overlap a laterally extending part 12*a* of the signal line 10, the bridging part 45*c* and the reinforcing part 46*c* partially overlap a laterally extending part 12*c*, and the front-end frame part 43 partially overlaps a laterally extending part 12*d*.

In addition, the laterally extending part 12*b* overlapping the bridging part 45*a* and the reinforcing parts 46*a*, 46*a* laterally crosses the through part 48*a*. Also, the laterally extending part 12*a* overlapping the bridging part 45*b* and the reinforcing part 46*b* laterally crosses the through part 48*b*, the laterally extending part 12*c* overlapping the bridging part 45*c* and the reinforcing part 46*c* laterally crosses the through part 48*c*, and the laterally extending part 12*d* overlapping the front-end frame part 43 laterally crosses the through part 48*d*. That is, since the bridging part and the reinforcing part adjacent to each other are separated from each other, there is a region where no dielectric material overlaps the laterally extending parts 12*a*, 12*b*, 12*c*, and 12*d*.

On the other hand, as shown in FIG. 7, when the dielectric member 20 is moved from the reference position to the arrow a direction, both of the frame body 40 and the dielectric plate 50 overlap the signal line 10. Specifically, the frame body 40 and the first dielectric plate 51 partially overlap the laterally extending part 12*a* of the signal line 10, the second dielectric plate 52 partially overlaps the laterally extending part 12*b*, the third dielectric plate 53 partially overlaps the laterally extending part 12*d*, and the fourth dielectric plate 54 partially overlaps the laterally extending part 12*c*.

That is, the dielectric member 20 can move to a first position at which the area of the frame body 40 occupying the overlapping area with the signal line 10 is larger than the area of the dielectric plate 50 and a second position at which the area of the dielectric plate 50 occupying the overlapping area with the signal line 10 is larger than the area of the frame body 40.

Furthermore, since each dielectric plate 50 has a triangular shape as described above, the overlapping area between each dielectric plate 50 and the signal line 10 is increased as the dielectric member 20 shown in FIG. 6 moves to the arrow a direction. On the other hand, the overlapping area between each dielectric plate 50 and the signal line 10 is decreased as the dielectric member 20 shown in FIG. 7 moves to the arrow b direction. That is, the overlapping area between each dielectric plate 50 and the signal line 10 is increased or decreased by the reciprocation of the dielectric member 20. Therefore, the impedance is changed in accordance with the moving amount of the dielectric member 20, and the phase of the signal propagating through the signal line 10 is changed. Specifically, the phase delay amount is increased as the dielectric member 20 located at the reference position moves to the arrow a direction.

As described above, when the dielectric member 20 is located at the reference position shown in FIG. 6, only the frame body 40 overlaps the signal line 10. In other words, when the dielectric member 20 is located at the reference position, the overlapping area between the dielectric plate 50 and the signal line 10 is 0 (zero). Furthermore, the permittivity ($\epsilon 2$) of the frame body 40 is lower than the permittivity ($\epsilon 1$) of the dielectric plate 50. That is, when the dielectric member 20 is located at the reference position, only the low permittivity portion (the frame body 40) of the dielectric member 20 overlaps the signal line 10. On the other hand, when the dielectric member 20 is moved from the reference position to the arrow a direction, both of the low permittivity portion (the frame body 40) and the high permittivity portion (the dielectric plate 50) of the dielectric member 20 overlap the signal line 10. In other words, a difference between the overlapping area between the high permittivity portion and the signal line 10 formed before the movement of the dielectric member 20 and the overlapping area between the high permittivity portion and the signal line 10 formed after the movement of the dielectric member 20 is large.

Furthermore, when the dielectric member 20 is located at the reference position shown in FIG. 6, the laterally extending parts 12*a*, 12*b*, 12*c*, and 12*d* of the signal line 10 intersecting the dielectric member 20 laterally cross the through parts 48*a*, 48*b*, 48*c*, and 48*d* formed in the frame body 40, respectively. That is, there is a region where no dielectric material overlaps the laterally extending parts 12*a*, 12*b*, 12*c*, and 12*d* of the signal line 10. Therefore, a difference between the overlapping area between the dielectric material and the signal line 10 formed before the movement of the dielectric member 20 and the overlapping area between the dielectric material and the signal line 10 formed after the movement of the dielectric member 20 is large.

Therefore, even if the area of the dielectric plate 50 included in the dielectric member 20 is small, the impedance of the signal line 10 is significantly changed before and after the movement of the dielectric member 20, and the phase delay amount is significantly changed (increased).

Also, in the present embodiment, the plurality of dielectric plates 50 independent from each other are integrated by the frame body 40. Thus, a degree of flexibility in selecting the material of the dielectric plate 50 is high. This is because, if the frame body 40 does not exist, it is required to integrally form portions corresponding to the bridging parts 45*a*, 45*b*, and 45*c* in the dielectric plates 50 in order to integrate the plurality of dielectric plates 50 together. In this case, when the material of the dielectric plates 50 is selected, it is required to consider not only the permittivity but also process performance and strength, and therefore, the degree of flexibility in selecting the material of the dielectric plates 50 decreases.

Also, the dielectric member 20 according to the present embodiment is configured of the plurality of dielectric plates 50 and the frame body 40 having a strength higher than those of these dielectric plates 50 and holding these dielectric plates 50. Thus, the dielectric member 20 according to the present embodiment has a higher strength and is more excellent in durability than those of the dielectric member configured of only dielectric plates.

Also, the reference position shown in FIG. 6 is one first position, and the position shown in FIG. 7 is one second position. That is, even if only part of the dielectric plate 50 (in vicinity of a top of the dielectric plate 50) overlaps the signal line 10, the area of the frame body 40 occupying the overlapping area of the dielectric member 20 with respect to the signal line 10 is larger than the area of the dielectric plate 50.

Figure 8:
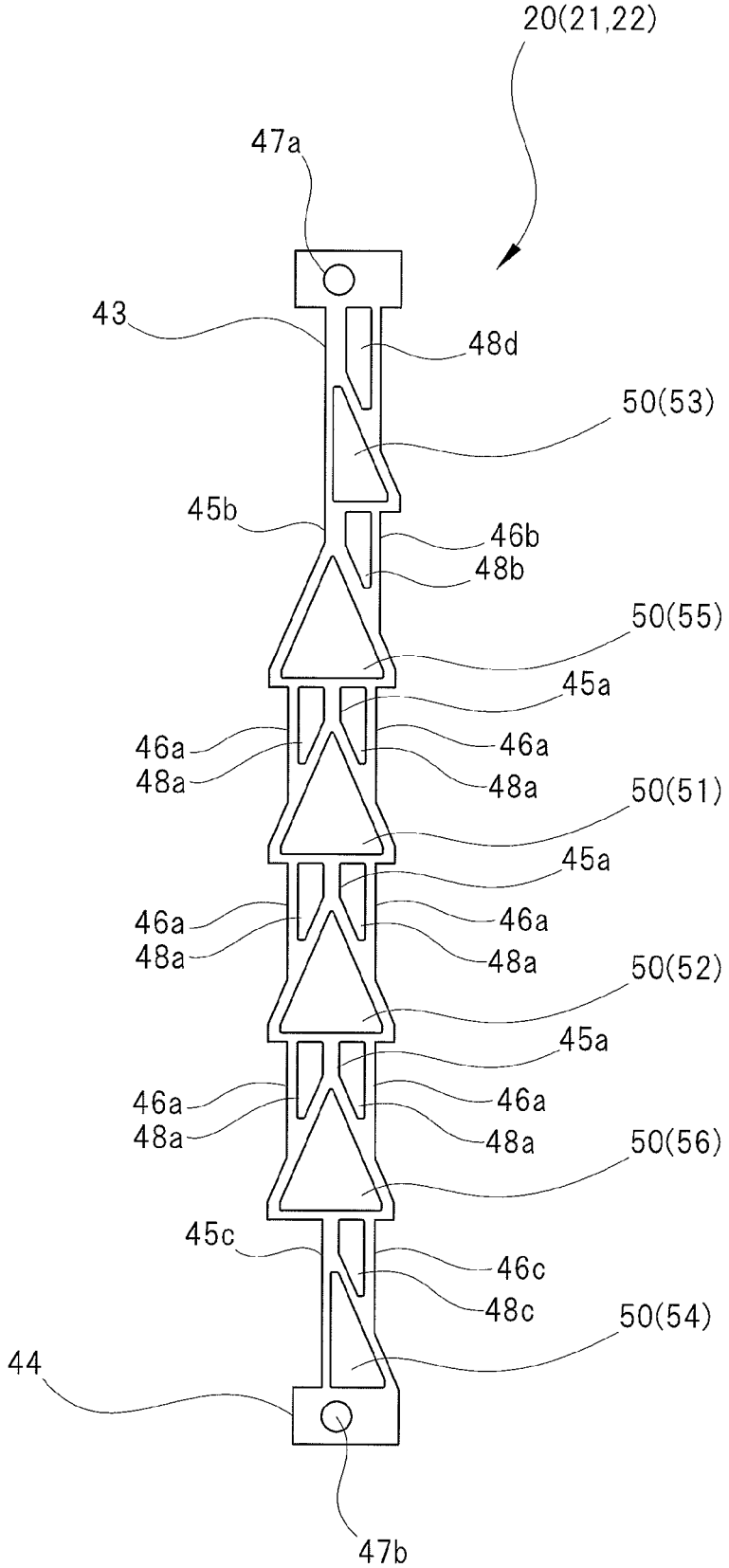
FIG. 8 is an enlarged plan view showing a modification example of the dielectric member.

The present invention is not limited to the foregoing embodiments and various modifications and alterations can be made within the scope of the present invention. For example, the number of dielectric plates 50 included in the dielectric member 20 is not particularly limited. FIG. 8 shows an example of the dielectric member 20 to which electric plates 50 are additionally provided. In the dielectric member 20 shown in FIG. 8, a fifth dielectric plate 55 is added between the first dielectric plate 51 and the third dielectric plate 53, and a sixth dielectric plate 56 is added between the second dielectric plate 52 and the fourth dielectric plate 54. Also, with the addition of the dielectric plates 50, frame parts, bridging parts, and reinforcing parts of the frame body 40 are added appropriately. Note that the same or substantially same members and portions as the already-described members and portions are denoted by the same reference symbols in FIG. 8, and the description thereof is omitted.

The frame body 40 in the above-described embodiment is made of polyacetal resin, and the dielectric plate 50 is made of polyphenylene sulfide resin. However, the materials of the frame body 40 and the dielectric plate 50 are not restricted to a specific material.

What is claimed is:

1. A phase-shift circuit comprising:

a signal line; and a dielectric member overlapping the signal line and being capable of reciprocating in a direction intersecting the signal line, and changing a phase of a signal propagating through the signal line, wherein the dielectric member is configured of a frame body and a dielectric plate provided inside the frame body and having an overlapping area with the signal line increased or decreased by the reciprocation, and the frame body has a permittivity lower than a permittivity of the dielectric plate.

2. The phase-shift circuit according to claim 1, wherein the dielectric member can move to a first position at which an area of the frame body occupying an overlapping area with the signal line is larger than an area of the dielectric plate and a second position at which an area of the dielectric plate occupying an overlapping area with the signal line is larger than an area of the frame body.

3. The phase-shift circuit according to claim 1, wherein the dielectric member has a first dielectric plate and a second dielectric plate adjacent to each other in a moving direction, the frame body includes a first frame part surrounding the first dielectric plate and a second frame part surrounding the second dielectric plate, the first dielectric plate and the second dielectric plate are independent from each other, and the first frame part and the second frame part are integrally formed.

4. The phase-shift circuit according to claim 3, wherein the frame body includes a bridging part integrally formed with the first frame part and the second frame part and lying across the first frame part and the second frame part.

5. The phase-shift circuit according to claim 4, wherein the frame body includes a reinforcing part integrally formed with the first frame part and the second frame part and lying across the first frame part and the second frame part, and the reinforcing part is provided on at least one side of the bridging part so as to be separated from the bridging part.

6. The phase-shift circuit according to claim 1, wherein a gap between the signal line and the frame body facing each other is narrower than a gap between the signal line and the dielectric plate facing each other.

7. An antenna device comprising:

a plurality of phase-shift circuits for changing a phase of an input signal; and a plurality of antenna elements to which a signal outputted from each of the phase-shift circuits is inputted, wherein at least one of the plurality of phase-shift circuits includes: a signal line; and a dielectric member overlapping the signal line and being capable of reciprocating in a direction intersecting the signal line, the dielectric member is configured of a frame body and a dielectric plate provided inside the frame body and having an overlapping area with the signal line increased or decreased by the reciprocation, and the frame body has a permittivity lower than a permittivity of the dielectric plate.

8. The antenna device according to claim 7, wherein the dielectric member included in the phase-shift circuit can move to a first position at which an area of the frame body occupying an overlapping area with the signal line is larger than an area of the dielectric plate and a second position at which an area of the dielectric plate occupying an overlapping area with the signal line is larger than an area of the frame body.

9. The antenna device according to claim 7, wherein the dielectric member has a first dielectric plate and a second dielectric plate adjacent to each other in a moving direction, the frame body includes a first frame part surrounding the first dielectric plate and a second frame part surrounding the second dielectric plate, the first dielectric plate and the second dielectric plate are independent from each other, and the first frame part and the second frame part are integrally formed.

10. The antenna device according to claim 9, wherein the frame body includes a bridging part integrally formed with the first frame part and the second frame part and lying across the first frame part and the second frame part.

11. The antenna device according to claim 10, wherein the frame body includes a reinforcing part integrally formed with the first frame part and the second frame part and lying across the first frame part and the second frame part, and the reinforcing part is provided on at least one side of the bridging part so as to be separated from the bridging part.

12. The antenna device according to claim 7, wherein a gap between the signal line and the frame body facing each other in the phase-shift circuit is narrower than a gap between the signal line and the dielectric plate facing each other.

* * * * *